United States Patent [19]

Chan

[11] 3,997,326

[45] Dec. 14, 1976

[54] HERBICIDAL N-(N'-ALKYNYLCARBAMYLMETHYL) 2,6-DIALKYL-ALPHA-HALOACETANILIDES

[75] Inventor: David Cheong King Chan, San Francisco, Calif.

[73] Assignee: Chevron Research Company, San Francisco, Calif.

[22] Filed: Feb. 23, 1976

[21] Appl. No.: 660,086

Related U.S. Application Data

[63] Continuation-in-part of Ser. No. 515,781. Oct. 17, 1974, Pat. No. 3,944,607

[52] U.S. Cl. ..... 71/118

[51] Int. Cl.[2] ..... A01N 9/20

[58] Field of Search ..... 71/118

[56] References Cited

UNITED STATES PATENTS

| | | | |
|---|---|---|---|
| 3,475,157 | 10/1969 | Olin | 71/118 |
| 3,481,979 | 12/1969 | Horrom et al. | 71/118 X |
| 3,640,699 | 2/1972 | Horrom et al. | 71/118 |
| 3,829,306 | 8/1974 | Ratts | 71/118 X |

*Primary Examiner*—Lewis Gotts
*Assistant Examiner*—Catherine L. Mills
*Attorney, Agent, or Firm*—G. F. Magdeburger; D. A. Newell; Raymond Owyang

[57] ABSTRACT

N-(N'-alkynylcarbamylmethyl)-2,6-dialkyl-alpha-haloacetanilides have herbicidal activity, particularly in preemergent applications against grassy weeds.

14 Claims, No Drawings

HERBICIDAL N-(N'-ALKYNYLCARBAMYLMETHYL) 2,6-DIALKYL-ALPHA-HALOACETANILIDES

CROSS-REFERENCE TO RELATED APPLICATION

This application is a continuation-in-part of application Ser. No. 515,781, filed Oct. 17, 1974, now U.S. Pat. No. 3,944,607.

DESCRIPTION OF THE PRIOR ART

U.S. Pat. No. 3,780,090 of Akiba et al and Belgian Pat. No. 796,263 of Hercules disclose the use of alkyl alpha-(N-haloacetyl-N-2,6-dialkyl phenylamino)-alkanoate esters as herbicides. German Offen. No. 2,350,944 of Ciba Geigy discloses alpha-(N-haloacetyl-N-2,6-dialkylphenylamino) alkanoate esters as antifungal agents. Belgian Pat. No. 813,469 of Ciba Geigy discloses the use of phenylamine acetamides as herbicides.

DESCRIPTION OF THE INVENTION

The N-(N'-alkynylcarbamylmethyl)-2,6-dialkyl-alpha-haloacetanilide compounds of the invention are represented by the formula (I):

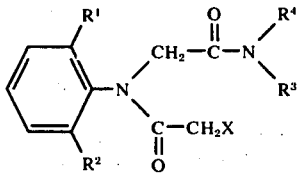

(I)

wherein $R^1$ and $R^2$ individually are lower alkyl groups of 1 to 6 carbon atoms, $R^3$ is hydrogen, lower alkyl of 1 to 6 carbon atoms, lower haloalkyl of 1 to 2 carbon atoms and 1 to 4 chlorine or bromine, or lower alkynyl of 3 to 6 carbon atoms; $R^4$ is lower alkynyl of 3 to 6 carbon atoms; and X is fluorine, chlorine, bromine or iodine.

Representative alkyl groups which $R^1$, $R^2$ and $R^3$ may represent include methyl, ethyl, propyl, isopropyl, butyl, sec-butyl, t-butyl, pentyl, isohexyl, hexyl, etc. Representative haloalkyl groups which $R^3$ may represent include chloromethyl, dichloromethyl, tribromomethyl and tetrachloroethyl. Representative alkynyl groups which $R^3$ and $R^4$ may represent include propargyl, 2-butynyl, 3-pentynyl, etc.

Preferably $R^1$ and $R^2$ are alkyl of 1 to 3 carbon atoms, $R^3$ is hydrogen or alkyl of 1 to 3 carbon atoms, $R^4$ is 2-alkynyl, and X is chlorine or bromine.

Representative compounds of Formula (I) are:

N-(N'-propargylcarbamylmethyl)-2,6-dimethyl-alpha-chloroacetanilide

N-(N'-propargylcarbamylmethyl)-2,6-diethyl-alpha-chloroacetanilide

N-(N',N'-dipropargylcarbamylmethyl)-2,6-dimethyl-alpha-chloroacetanilide

N-(N'-2-butynylcarbamylmethyl)-2,6-diisopropyl-alpha-bromoacetanilide

N-(N'-3-hexynylcarbamylmethyl)-2,6-dimethyl-alpha-fluoroacetanilide

N-(N'-propargyl-N'-chloromethylcarbamylmethyl)-2,6-dimethyl-alpha-bromoacetanilide N-(N'-propargyl-N'-isopropylcarbamylmethyl)-2,6-dimethyl-alpha-iodoacetanilide and N-(N'-2-butynyl-N'-methylcarbamylmethyl)-2-methyl-6-ethyl-alpha-chloroacetanilide.

The compound of the invention may be prepared by alkylating a 2,6-dialkylaniline (II) with an alpha-haloamide (III) to produce an N-carbamylmethyl-2,6-dialkylaniline (IV) and subsequently acylating the N-carbamylmethyl-2,6-dialkylphenylamine (IV) with an alpha-haloacetyl halide (V) to give the N-carbamylmethyl-2,6-dialkyl-alpha-haloacetanilide product (I). This sequence of reactions is depicted by the following equations:

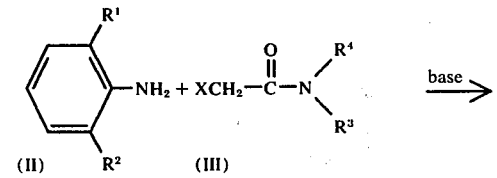

(II) (III) (1)

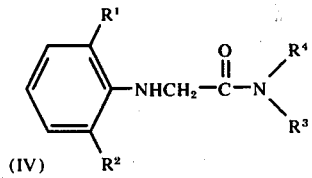

(IV) (2)

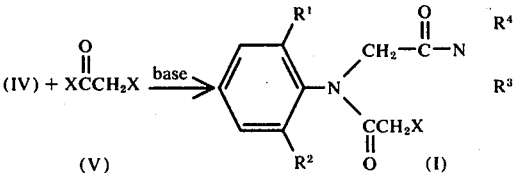

(IV) (V) (I)

wherein $R^1$, $R^2$, $R^3$, $R^4$ and X have the same significance as previously defined.

The alkylation reaction (1) is conducted in the presence of a base. Suitable bases are inorganic alkali metal carbonates such as sodium carbonate or potassium carbonate. Generally, substantially equimolar amounts of reactants (II) and (III) and the base are employed. The reaction is conducted in inert polar organic solvents, e.g., apolar diprotic solvents such as dimethylformamide and acetonitrile, at reaction temperatures varying from 0° to 90° C, preferably from 20° to 50° C. The reaction pressure may be atmospheric, subatmospheric, or superatmospheric. However, for convenience of conducting the reaction, the pressure is generally atmospheric. The reaction time will, of course, vary depending upon the reactants and the reaction temperature. Generally the reaction time is from 0.25 to 24 hours. The product (IV) is generally purified by conventional procedures, e.g., extraction, distillation or crystallization, before use in the acylation reaction (2).

The acylation reaction (2) is conducted by conventional procedures in the presence of an organic base such as a trialkyl amine or a pyridine compound. The reactants (IV) and (V) and the base are generally contacted in substantially equimolar amounts in an inert organic solvent at a temperature of 0° to 50° C. Suitable inorganic solvents include ethyl acetate, methylene chloride, dimethoxyethane, benzene, etc. The product is isolated and purified by conventional procedures such as extraction, distillation, crystallization, etc.

The N-carbamylmethyl-2,6-dialkylaniline intermediate (IV) may also be prepared by alkylating an aniline compound (II) with an alkyl alpha-halothioacetate (VI) and subsequently reacting the alpha-(N-phenylaminothioacetate VII) with an amine in the liquid phase to produce the N-carbamylmethyl-2,6-dialkylaniline intermediate (IV), as depicted by the following reactions:

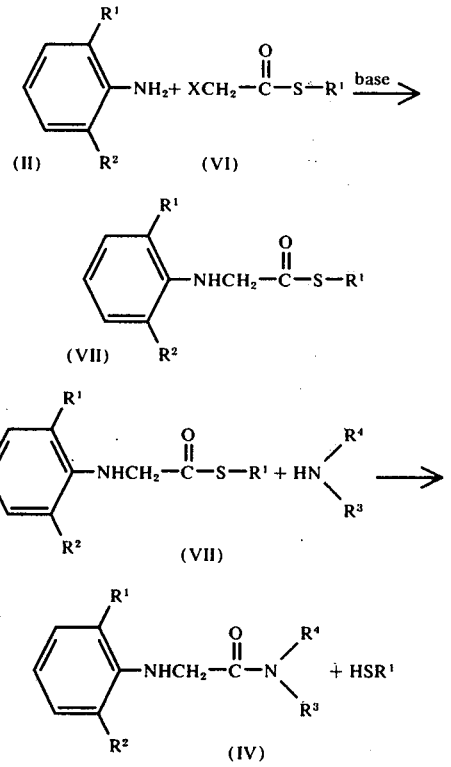

wherein $R^1$, $R^2$, $R^3$, $R^4$ and X have the same significance as previously defined.

The alkylation reaction (3) is conducted by a procedure essentially identical to that described for reaction 1. In reaction (3) the thioacetate ester (VI) is preferably a lower alkyl alpha-halothioacetate, i.e., $R^1$ is alkyl of 1 to 3 carbon atoms.

Reaction (4) is preferably conducted in an inert liquid diluent. Suitable diluents include water, organic solvents, e.g., apolar diprotic solvents such as dimethylformamide and acetonitrile, and mixtures of water and organic solvents. Generally, substantially equimolar amounts of the thioacetate ester (VI) and the amine are employed, although an excess of the amine may be employed. The reaction temperatures vary from 0° to 100° C and the reaction pressure may be atmospheric, subatmospheric or superatmospheric. The reaction time will, of course, vary depending upon the reactants and the reaction temperature. Generally, the reaction time is 0.25 to 24 hours. To decrease the reaction time, the reaction may be conducted in the presence of an organic base such as a pyridine compound or a trialkylamine. Suitable pyridine compounds include pyridine, alpha-picoline, 3,5-dimethylpyridine, etc., and suitable trialkylamines include trimethylamine, tributylamine, etc. When a base is employed, amounts of base from about 0.01 to 1 mol per mol of thioate ester are generally satisfactory.

EXAMPLES

The preparation of the compounds of the invention is illustrated by the following examples.

EXAMPLE 1 — Preparation of N-(N'-propargyl-N' methylcarbamylmethyl)-2,6-dimethyl-alpha-chloroacetanilide

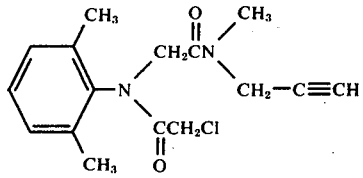

A solution of 13.8 g (0.2 mol) of N-methylpropargylamine in 20 ml methylene chloride was added dropwise to a stirred and cooled (below 15° C) solution of 40.2 g (0.2 mol bromoacetyl bromide and 16 g (0.2 mol) sodium bicarbonate in 250 ml methylene chloride. The reaction mixture was allowed to warm to about 25° C and stirred for 2 hours. The reaction mixture was then filtered and evaporated under reduced pressure to give an oily residue. The residue was diluted with 150 ml ethyl ether to form a two-phase mixture consisting of an ether phase and a dark oil. The ether phase was separated, dried over magnesium sulfate, and evaporated to give 32.3 g of N-methyl-N-propargyl-alpha-bromoacetamide.

A mixture of 16.2 g (0.085 mol) N-methyl-N-propargyl-alpha-bromoacetamide (prepared above), 10.2 g (0.085 mol) 2,6-dimethylaniline and 8.9 g (0.085 mol) sodium carbonate in 200 ml dimethylformamide was heated at 140° C for 14 hours. The reaction mixture was diluted with 300 ml water and extracted with benzene. The benzene extracts were washed with water, dried over magnesium sulfate and evaporated under reduced pressure to give a viscous oil. The oil was chromatographed on a silica-gel column. N-(N'-methyl-N'-propargylcarbamylmethyl)-2,6-dimethylaniline was eluted from the column with 50:50 hexane-ethyl ether.

A sample of 3.2 g (0.029 mol) chloroacetyl chloride was added dropwise to a stirred and warmed (45°–50° C) solution of 6.6 g (0.029 mol) N-(N'-methyl-N'-propargylcarbamylmethyl)-2,6-dimethylaniline (prepared above) and 2.3 g (0.029 mol) pyridine in 250 ml of methylene chloride. The reaction mixture was stirred at about 25° C for 1 hour. The reaction mixture was washed with 250 ml water, with aqueous sodium bicarbonate and then water, dried over magnesium sulfate and evaporated under reduced pressure to give a viscous oil. The oil was crystallized from ether to give the product, N-(N'-methyl)-N'-propargylcarbamylmethyl)-2,6-dimethyl-alpha-chloroacetanilide, as a colorless solid, m.p. 72°–74° C. Elemental analysis for $C_{16}H_{19}ClN_2O_2$ showed: %Cl, calculated 11.6, found 11.8.

By a procedure similar to that above:

a. Alpha-chloroacetyl chloride and N-(N'-methyl-N'-propargylcarbamylmethyl)-2,6-diethylaniline were reacted in the presence of pyridine to produce N-(N'-methyl-N'-propargylcarbamylmethyl)-2,6-diethyl-alpha-chloroacetanilide as a colorless solid, m.p. 69°–70° C. Elemental analysis for $C_{18}H_{23}ClN_2O_2$ showed: %Cl, calculated 10.6, found 10.5.

b. Alpha-chloroacetyl chloride and N-(N'-1,1-dimethyl-2-propynylcarbamylmethyl)-2,6-diethylaniline were reacted in the presence of pyridine in ethyl acetate to produce N-(N'-1,1-dimethyl-2-propynylcarbamylmethyl)-2,6-diethyl-alpha-chloroacetanilide as a white solid, m.p. 114°–115° C. Elemental analysis for $C_{19}H_{25}ClN_2O_2$ showed: %Cl, calculated 10.2, found 10.1. The structural formula of this product is:

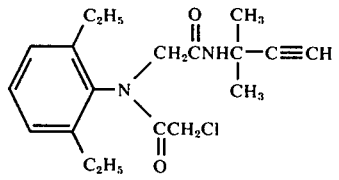

c. Alpha-chloroacetyl chloride and N-(N'-1,1-dimethyl-2-propynylcarbamylmethyl)-2,6-dimethylaniline were reacted in the presence of pyridine in ethyl acetate to produce N-(N'-1,1-dimethyl-2-propynylcarbamylmethyl)-2,6-dimethyl-alpha-chloroacetanilide as a white solid, m.p. 100°–102° C. Elemental analysis for $C_{17}H_{21}ClN_2O_2$ showed: %Cl, calculated 11.0, found 11.1.

d. Alpha-chloroacetyl chloride and N-(N'-propargylcarbamylmethyl)2,6-dimethylaniline were reacted in the presence of pyridine to produce N-(N'-propargylcarbamylmethyl)-2,6-dimethyl-alpha-chloroacetanilide as a white solid, m.p. 89°–94° C. Elemental analysis for $C_{15}H_{17}ClN_2O_2$ showed: %Cl, calculated 12.1, found 11.0.

e. Alpha-chloracetyl chloride and N-(N'-propargylcarbamylmethyl)-2,6-diethylaniline were reacted in the presence of pyridine to produce N-(N'-propargylcarbamylmethyl)-2,6-diethyl-alpha-chloroacetanilide as a white solid, m.p. 97°–99° C. Elemental analysis for $C_{17}H_{21}ClN_2O_2$ showed: %Cl, calculated 11.1, found 10.4.

EXAMPLE 2 — Preparation of isopropyl alpha-(N-2,6-dimethylphenylamino)thioacetate Isopropyl mercaptan (7.6 g, 0.1 mol) was added dropwise to a stirred and cooled (ice bath) solution of 20.2 g (0.1 mol) bromoacetyl bromide in 250 ml methylene chloride. The reaction was allowed to warm to about 25° C and stirred for 48 hours. Nitrogen gas was then bubbled into the reaction mixture to remove dissolved hydrogen bromide. The reaction mixture was evaporated under reduced pressure to give 21 g of crude isopropyl alpha-bromothioacetate (contaminated by a little $CH_2Cl_2$).

A slurry of 10.6 g (0.05 mol) isopropyl alpha-bromothioacetate (prepared above), 6.1 g (0.05 mol) 2,6-dimethylaniline, and 5.3 g (0.05 mol) sodium carbonate in 150 ml dimethylformamide was stirred at 25° C for 24 hours. The reaction mixture was diluted with water and extracted with benzene. The benzene extracts were washed with water, dried over magnesium sulfate and evaporated under reduced pressure to give an oil. The oil was chromatographed on 200 g silica gel. Isopropyl alpha-(N-2,6-dimethylphenylamino)thioacetate (9 g) was eluted from the silica gel with 97.5/2.5 hexane/ether.

EXAMPLE 3 — Preparation of ethyl alpha-(N-2-methyl-6-ethylphenylamino)thioacetate A slurry of 24.2 g (0.2 mol) ethyl alpha-bromothio acetate, 36.8 g (0.2 mol) 2-methyl-6-ethylaniline and 2.2 g (0.2 mol) sodium carbonate in 200 ml dimethylformamide was stirred at 25° C for 5 days. The reaction mixture was diluted with about 25 ml water and extracted with benzene. The benzene extracts were washed with water, dried over magnesium sulfate and evaporated under reduced pressure to give 48.2 g of ethyl alpha-(N-2-methyl-6-ethylphenylamino)thioacetate.

EXAMPLE 4 — Preparation of N-(N'-propargyl carbamylmethyl)-2-methyl-6-ethyl-alpha-chloroacetanilide A solution of 24.2 g (0.096 mol) ethyl alpha-(N-2-methyl-6-ethylphenylamino)thioacetate, 5.5 g (0.1 mol) propargylamine and 0.5 g pyridine in 250 ml acetonitrile was stirred at 25° C for about 16 hours. The reaction mixture was then evaporated under reduced pressure and the residue was chromatographed on 250 g silica gel (50% ether/hexane eluent) to give 15.8 g of N-(N'-propargylcarbamylmethyl)-2-methyl-6-ethylaniline.

A sample of 2.5 g (0.022 mol) chloroacetyl chloride was added dropwise to a solution of 5 g (0.022 mol) N-(N'-propargylcarbamylmethyl)-2-methyl-6-ethylaniline and 1.9 g (0.022 mol) pyridine in 150 ml methylene chloride. The reaction mixture was then washed with water, dried over magnesium sulfate and evaporated to give a viscous oil. The oil was crystallized from ether to give the product, N-(N'-propargylcarbamylmethyl)-2-methyl-6-ethyl-alpha-chloroacetanilide, as a colorless solid, m.p. 83°–85° C. Elemental analysis for $C_{16}H_{19}ClN_2O_2$ showed: %Cl, calc. 11.6, found 12.0.

EXAMPLE 5 — Preparation of N-(N'-methyl-N' propargylcarbamylmethyl)-2,6-dimethyl-alpha-chloroacetanilide A solution of 543 g (2.6 mols) methyl alpha-(N-2,6-dimethylphenylamino)thioacetate, 179 g (2.6 mols) N-methylproparglyamine and 205 g pyridine was heated under reflux for 5 hours and then at 25° C for 16 hours. The reaction mixture was diluted with methylene chloride, washed with water, dried over magnesium sulfate and evaporated to give a solid residue. Crystallization from 50% hexane/isopropyl alcohol gave the N-(N'-methyl-N'-propargylcarbamylmethyl)-2,6-dimethylaniline product, m.p. 54°–55° C (63% yield).

The N-(N'-methyl-N-propargylcarbamylmethyl)-2,6-dimethylaniline was reacted with chloroacetyl chloride by a procedure similar to that of Example 4 to give N-(N'-methyl-N'-propargylcarbamylmethyl)-2,6-dimethyl-alpha-chloroacetanilide, as a colorless solid, m.p. 75° C.

EXAMPLE 6 — Preparation of N-(N'-methyl-N'-propargylcarbamylmethyl)-2-methyl-6-ethyl-alpha-chloroacetanilide The above compound was prepared by a procedure similar to that of Example 4. Elemental analysis for the compound as an oil ($C_{17}H_{21}ClN_2O_2$) showed: %Cl, calculated 11.1, found 10.3.

UTILITY

The compounds of the present invention are herbicidal in both pre- and post-emergent applications. For pre-emergent control of undesirable vegetation, the herbicidal compounds will be applied in herbicidally effective amounts to the locus or growth medium of the vegetation, e.g., soil infested with seeds and/or seedlings of such vegetation. Such application will inhibit the growth of or kill the seeds, germinating seeds and seedlings. For post-emergent applications, the herbicidal compounds will be applied directly to the foliage and other plant parts. Generally, the herbicidal compounds of the invention are effective against weed grasses as well as broadleaved weeds. The compounds are particularly effective as pre-emergent herbicides against broadleaved and grass weeds, with little or no phytotoxicity to crops such as oats, sorghum, cotton and peas.

The compounds of the present invention can be used alone as herbicides. However, it is generally desirable to apply the compounds in herbicidal compositions comprising one or more of the herbicidal compounds intimately admixed with a biologically inert carrier. The carrier may be a liquid diluent or a solid, e.g., in the form of dust powder or granules. In the herbicidal composition, the active herbicidal compounds can be from about 0.01 to 95% by weight of the entire composition.

Suitable liquid diluent carriers include water and organic solvents, e.g., hydrocarbons such as benzene, toluene, kerosene, diesel oil, fuel oil, and petroleum naphtha. Suitable solid carriers are natural clays such as kaolinite, atalpulgite and montmorillonite. In addition, talcs, pyrophillite, diatomaceous silica, synthetic fine silicas, calcium aluminosilicate and tricalcium phosphate are suitable carriers. Organic materials such as walnut-shell flour, cottonseed hulls, wheat flour, wood flour or redwood-bark flour may also be used as solid carriers.

The herbicidal composition will also usually contain a minor amount of a surface-active agent. Such surface agents are those commonly known as wetting agents, dispersing agents and emulsifying agents, and can be anionic, cationic or nonionic in character. The herbicidal compositions may also contain other pesticides, adjuvants, stabilizers, conditioners, fillers, and the like.

The amount of herbicidal compound or composition administered will vary with the particular plant part or plant growth medium which is to be contacted, the general location of application — i.e., sheltered areas such as greenhouses, as compared to exposed areas such as fields — as well as the desired type of control. Generally, for both pre- and post-emergent control, the herbicidal compounds of the invention are applied at rates of 0.2 to 60 kg/ha, and the preferred rate is in the range 0.5 to 40 kg/ha.

Pre-emergent herbicidal tests on representative compounds of the invention were made using the following method:

Pre-Emergent Test

An acetone solution of the test compound was prepared by mixing 750 mg of the compound, 220 mg of a nonionic surfactant and 25 ml of acetone. This solution was added to approximately 125 ml of water containing 156 mg of surfactant.

Seeds of the test vegetation were planted in a pot of soil and the test solution was sprayed uniformly onto the soil surface at a dose of 33 micrograms/cm$^2$. The pot was watered and placed in a greenhouse. The pot was watered intermittently and was observed for seedling emergence, healt of emerging seedlings, etc., for a 3-week period. At the end of this period, the herbicidal effectiveness of the compound was rated based on the physiological observations. A 0-to-100 scale was used, 0 representing no phytotoxicity, 100 representing complete kill. The results of these tests appear in Tables I, II and III.

TABLE I

| Example | | Herbicidal Effectiveness | | | | | |
|---|---|---|---|---|---|---|---|
| No. | Dosage | O | W | C | M | P | L |
| 1 | 33 mcg/cm$^2$ | 100 | 100 | 100 | 55 | 100 | 50 |
| 1a | 33 mcg/cm$^2$ | 100 | 100 | 100 | 10 | 50 | 0 |
| 1b | 33 mcg/cm$^2$ | 0 | 100 | 60 | 0 | 0 | 0 |
| 1c | 33 mcg/cm$^2$ | 98 | 100 | 98 | 0 | 0 | 0 |
| 1d | 33 mcg/cm$^2$ | 100 | 100 | 100 | 25 | 100 | 98 |
| 1e | 33 mcg/cm$^2$ | 90 | 100 | 100 | 10 | 70 | 50 |
| 4 | 33 mcg/cm$^2$ | 98 | 100 | 100 | 85 | 85 | 70 |
| 6 | 33 mcg/cm$^2$ | 100 | 100 | 100 | 85 | 100 | 93 |

O = Wild Oats (Avena fatua)
M = Mustard (Brassica arvensis)
W = Watergrass (Echinochloa crusgalli)
P = Pigweed (Amaranthus retroflexus)
C = Crabgrass (Digataria Sanguinalis)
L = Lambsquarter (Chenopodium album)

TABLE II

| | | Herbicidal Effectiveness | | | | | |
|---|---|---|---|---|---|---|---|
| Example | | Grass Weeds | | | Crops | | |
| No. | Dosage | Watergrass | Crabgrass | Yellow Foxtail | Wheat | Oats | Sorghum |
| 1 | 0.7 mcg/cm$^2$ | 100 | 70 | 70 | 7 | 2 | 0 |

TABLE III

| | | Herbicidal Effectiveness | | | | |
|---|---|---|---|---|---|---|
| | | Broadleaf Weeds | | Crops | | |
| No. | Dosage | Pigweed | Vetch | Peas | Cotton | Soybeans |
| 1 | 4.4 mcg/cm$^2$ | 100 | 97 | 5 | 0 | 10 |

What is claimed is:

1. A method for controlling the growth of undesirable vegetation which comprises applying to the vegetation or the growth medium of the vegetation an herbicidally effective amount of a compound of the formula

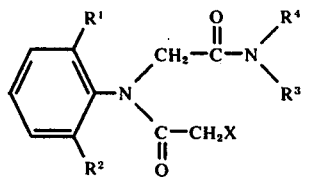

wherein $R^1$ and $R^2$ individually are alkyl of 1 to 6 carbon atoms; $R^3$ is hydrogen, alkyl of 1 to 6 carbon atoms, haloalkyl of 1 to 2 carbon atoms and 1 to 4 chlorine or bromine, or alkynyl of 3 to 6 carbon atoms; $R^4$ is alkynyl of 3 to 6 carbon atoms; and X is fluorine, chlorine, bromine or iodine.

2. The method of claim 1 wherein $R^3$ is hydrogen and $R^1$ and $R^2$ are alkyl of 1 to 3 carbon atoms.

3. The method of claim 2 wherein X is chlorine or bromine.

4. The method of claim 3 wherein $R^4$ is 2-alkynyl.

5. The method of claim 4 wherein $R^4$ is propargyl.

6. The method of claim 1 wherein $R^1$, $R^2$ and $R^3$ individually are alkyl of 1 to 3 carbon atoms.

7. The method of claim 6 wherein X is chlorine or bromine.

8. The method of claim 2 wherein $R^4$ is 2-alkynyl.

9. The method of claim 8 wherein $R^1$, $R^2$ and $R^3$ are methyl, $R^4$ is propargyl and X is chlorine.

10. An herbicidal composition comprising an herbicidally effective amount of the compound of claim 1 and a biologically inert carrier.

11. The composition of claim 10 wherein X is chlorine or bromine.

12. The composition of claim 11 wherein $R^3$ is hydrogen and $R^1$ and $R^2$ are alkyl of 1 to 3 carbon atoms.

13. The composition of claim 10 wherein $R^1$, $R^2$ and $R^3$ individually are alkyl of 1 to 3 carbon atoms.

14. The composition of claim 10 wherein $R^1$, $R^2$ and $R^3$ are methyl, $R^4$ is propargyl and X is chlorine.

* * * * *